US008181378B2

(12) United States Patent
Losinger

(10) Patent No.: US 8,181,378 B2
(45) Date of Patent: May 22, 2012

(54) WRAPAROUND GUN GRIP

(76) Inventor: Derik Losinger, Page, AZ (US)

( * ) Notice: Subject to any disclaimer, the term of this patent is extended or adjusted under 35 U.S.C. 154(b) by 26 days.

(21) Appl. No.: 12/791,675

(22) Filed: Jun. 1, 2010

(65) Prior Publication Data

US 2011/0289812 A1 Dec. 1, 2011

(51) Int. Cl.
*F41C 23/10* (2006.01)

(52) U.S. Cl. ..... 42/85; 42/71.02

(58) Field of Classification Search ..... 42/72, 74, 42/85, 106, 71.02; D22/108
See application file for complete search history.

(56) References Cited

U.S. PATENT DOCUMENTS 2,832,166 A * 4/1958 Ivy ..... 42/72
3,815,270 A * 6/1974 Pachmayr ..... 42/71.02
4,043,066 A * 8/1977 Pachmayr et al. ..... 42/71.02
4,346,530 A * 8/1982 Stewart et al. ..... 42/71.01
D269,895 S * 7/1983 Bianchi et al. ..... D22/104
4,613,537 A * 9/1986 Krupper ..... 428/192
4,936,036 A * 6/1990 Sniezak et al. ..... 42/71.02
4,967,503 A * 11/1990 Farrar ..... 42/71.02
5,231,237 A * 7/1993 Cupp ..... 42/71.02
5,279,060 A * 1/1994 Watson ..... 42/96
D344,124 S * 2/1994 Cupp ..... D22/108
D349,938 S * 8/1994 Hogue et al. ..... D22/108
5,465,520 A * 11/1995 Cupp ..... 42/71.02
5,560,136 A * 10/1996 Cupp ..... 42/71.02
5,621,997 A * 4/1997 Pearce ..... 42/71.02
5,768,817 A * 6/1998 Simons ..... 42/71.02
5,797,207 A * 8/1998 Marable et al. ..... 42/71.02
6,073,381 A * 6/2000 Farrar et al. ..... 42/71.02
6,804,907 B1 * 10/2004 Slobodkin ..... 42/71.02
6,964,382 B2 * 11/2005 Alexander et al. ..... 239/526
6,974,626 B2 * 12/2005 Horacek ..... 428/354
7,287,455 B2 * 10/2007 Key-Carniak et al. ..... 89/36.01
D560,750 S * 1/2008 Potter ..... D22/108
7,748,153 B2 * 7/2010 Beretta ..... 42/71.02
7,937,874 B2 * 5/2011 Roth ..... 42/72
2003/0034366 A1 * 2/2003 Sloan ..... 224/192
2003/0134088 A1 * 7/2003 Chen et al. ..... 428/156
2007/0082569 A1 * 4/2007 Gorres ..... 442/149
2007/0148409 A1 * 6/2007 Rios et al. ..... 428/167
2008/0020166 A1 * 1/2008 Esposito et al. ..... 428/41.7
2008/0105246 A1 * 5/2008 Marques et al. ..... 124/80
2009/0162596 A1 * 6/2009 Rios et al. ..... 428/45
2009/0258195 A1 * 10/2009 Lauer ..... 428/195.1
2010/0011483 A1 * 1/2010 Pinkart ..... 2/161.3
2010/0183814 A1 * 7/2010 Rios et al. ..... 427/387
2010/0281741 A1 * 11/2010 Gibson et al. ..... 42/71.02
2011/0167698 A1 * 7/2011 Hoguc ..... 42/71.02

* cited by examiner

*Primary Examiner* — Benjamin P Lee
(74) *Attorney, Agent, or Firm* — Morgan Law Officer, PLC

(57) ABSTRACT

A wraparound gun grip comprises a substantially flat continuous flexible sheet, the substantially flat continuous flexible sheet having a first side and a second side, the first side for adhering to a grip of a gun and the second side for providing improved gripping to a user of the gun, the substantially flat continuous flexible sheet cut to fit the gun's model. The wraparound gun grip is capable of being placed onto the gun by wrapping the wraparound gun grip around the factory grip of the gun. The wraparound gun grip includes one or more finger strips which can either be cut to size or tucked in. The second side can achieve increased friction by including abrading particles thereon (e.g., using sandpaper or grip tape). Alternatively, the grip side can be made from an elastomer, such as a synthetic rubber, or other material with the property of viscoelasticity.

13 Claims, 6 Drawing Sheets

WRAPAROUND GUN GRIP

FIELD OF THE INVENTION

The present invention relates to gun grips, and, more particularly, to a wraparound gun grip for improved gripping ability.

BACKGROUND

Conventionally, hand gun grips have been made of wood or molded rigid plastic material. Typically, the exterior surface of such grips include cross hatching or other friction improvement surface treatment. Although conventional hand gun grips have their benefits, many users complain of slippage. Accordingly, a need exists for an improved gun grip that would allow a shooter to achieve better gripping ability.

SUMMARY OF THE INVENTION

A wraparound gun grip comprises a substantially flat continuous flexible sheet, the substantially flat continuous flexible sheet having a first side and a second side, the first side for adhering to a grip of a gun and the second side for providing improved gripping to a user of the gun, the substantially flat continuous flexible sheet cut to fit the gun's model. The wraparound gun grip is capable of being placed onto the gun by wrapping the wraparound gun grip around the factory grip of the gun. The wraparound gun grip includes one or more finger strips which can either be cut to size or tucked in. The second side can achieve increased friction by including abrading particles thereon (e.g., using sandpaper or grip tape). Alternatively, the grip side can be made from an elastomer, such as a synthetic rubber, or other material with the property of viscoelasticity.

These and other aspects, features, and advantages of the present invention will become apparent from the following detailed description of preferred embodiments, which is to be read in connection with the accompanying drawings.

DETAILED DESCRIPTION

Figure 1A:
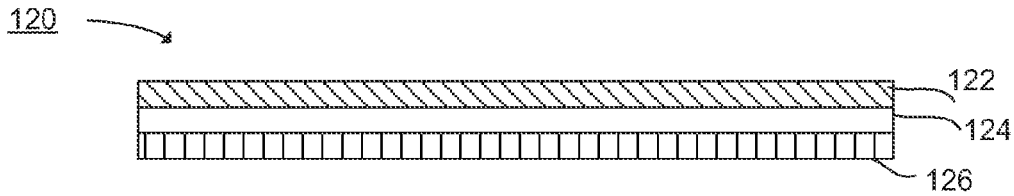
FIGS. 1(*a*) and 1(*b*) show side views of adhesive backed materials useable to create a wraparound gun grip according to embodiments of the present invention.
Figure 1B:
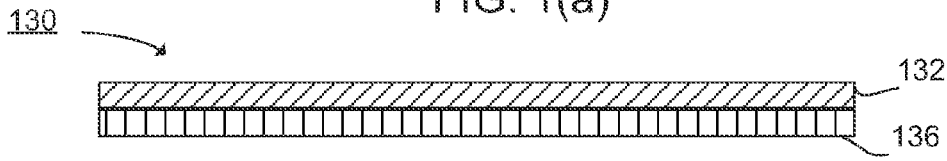

FIGS. 1(*a*) and 1(*b*) illustrate side views of adhesive backed materials useable to create a wraparound gun grip 200. In one embodiment of the invention, shown in FIG. 1(*a*), the material 120 includes a substrate 124, preferably paper or similar flat, flexible sheet. An abrasive side 122 of the material 120 includes a rough, abrasive surface. Preferably, the abrasive side 122 achieves abrasion by including abrading particles of silicon carbide, aluminum oxide, garnet, and/or emery thereon. Suitable material 120 include skateboard grip tape. Other suitable material 120 includes using medium (80-120 grit) sandpaper and a pressure sensitive adhesive applied to the smooth side of the sandpaper for the adhesive side 126. In an alternate embodiment of the invention, shown in FIG. 1(*b*), material 130 includes a viscoelastic side 132 made from an elastomer, such as a synthetic rubber, or other material with the property of viscoelasticity. In this embodiment, when the user presses his or her hand onto the wraparound gun grip 100, improved gripping is accomplished (in part) by slight deformation of the material 130.

The adhesive side 126, 136 (of either material 120, 130) includes a pressure sensitive adhesive capable of permanently adhering to a gun grip of a gun. By "permanently adhering", it is meant that removal requires considerable effort and that it will not come off during ordinary usage.

Figure 2A:
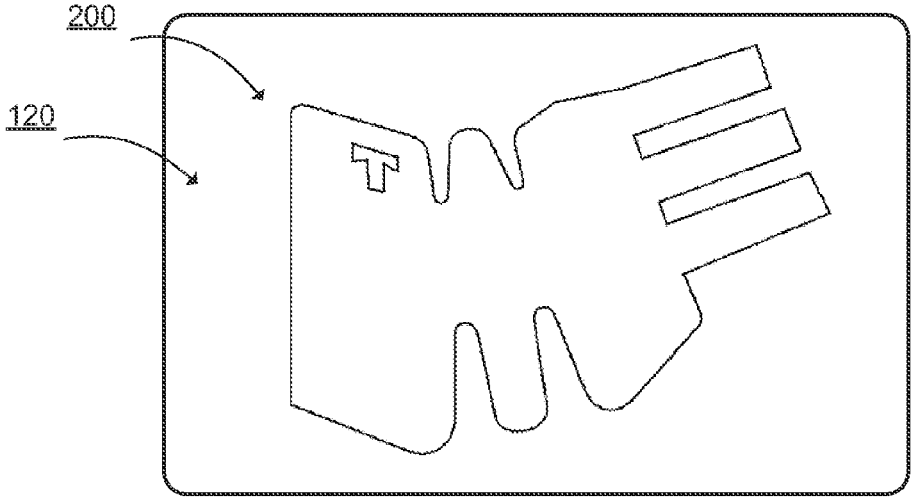
FIGS. 2(*a*) and 2(*b*) show an exemplary wraparound gun grip cut from a sheet of the material.
Figure 2B:
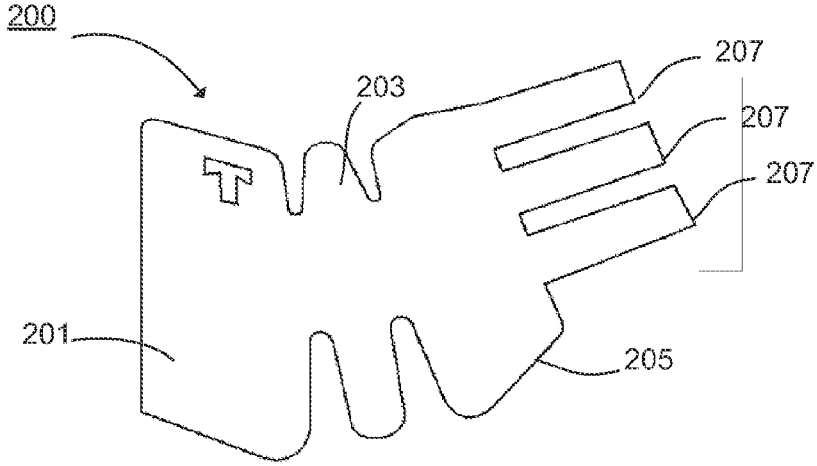

As illustrated in FIG. 2(*a*), an exemplary wraparound gun grip 200 is cut from a sheet of the material 120, 130. FIG. 2(*b*) shows the exemplary wraparound gun grip 200 after it has been cut. As will be described in greater detail, the wraparound gun grip 200 is designed to wraparound the grip of a gun fits specific gun models. For example, the embodiment of the wraparound gun grip 200 shown in FIG. 2(*a*) fits any full size GLOCK 9 mm handgun (e.g., Models: 17, 22, 31, 34, 35, and 37). It is to be appreciated that although several examples are shown herein, the drawings and description of the invention are meant to be illustrative, not limiting. Thus, it is to be understood that wraparound gun grips can also be created for various different manufacturers, and models and types of firearm other than those described herein.

Figure 3:
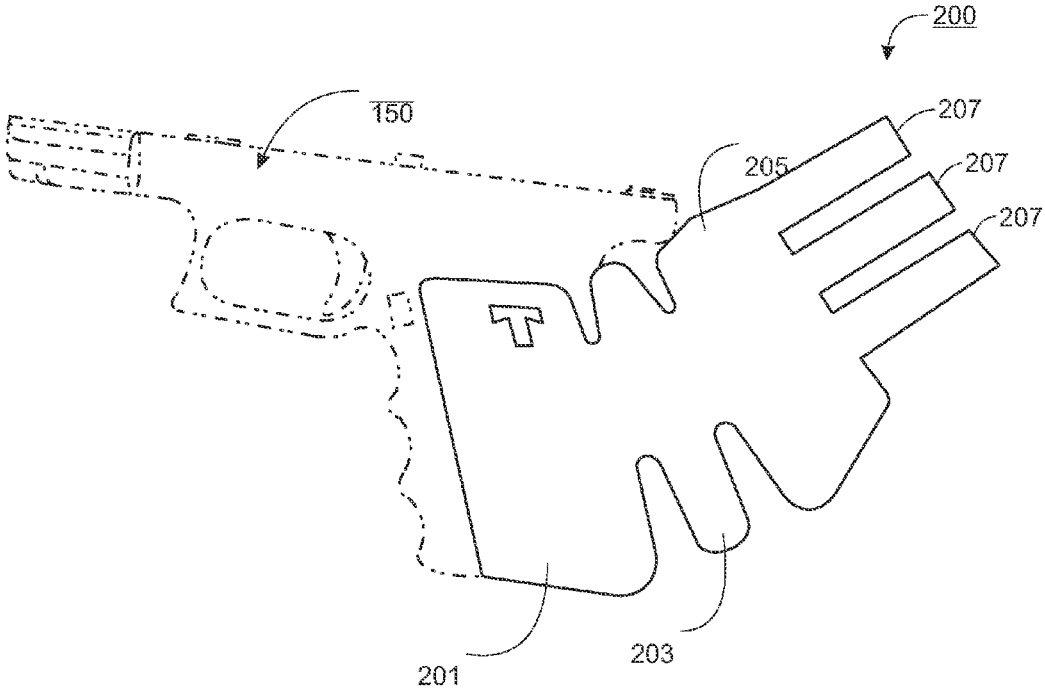
FIGS. 3 to 5 show the wraparound gun grip being applied to a gun.
Figure 4:
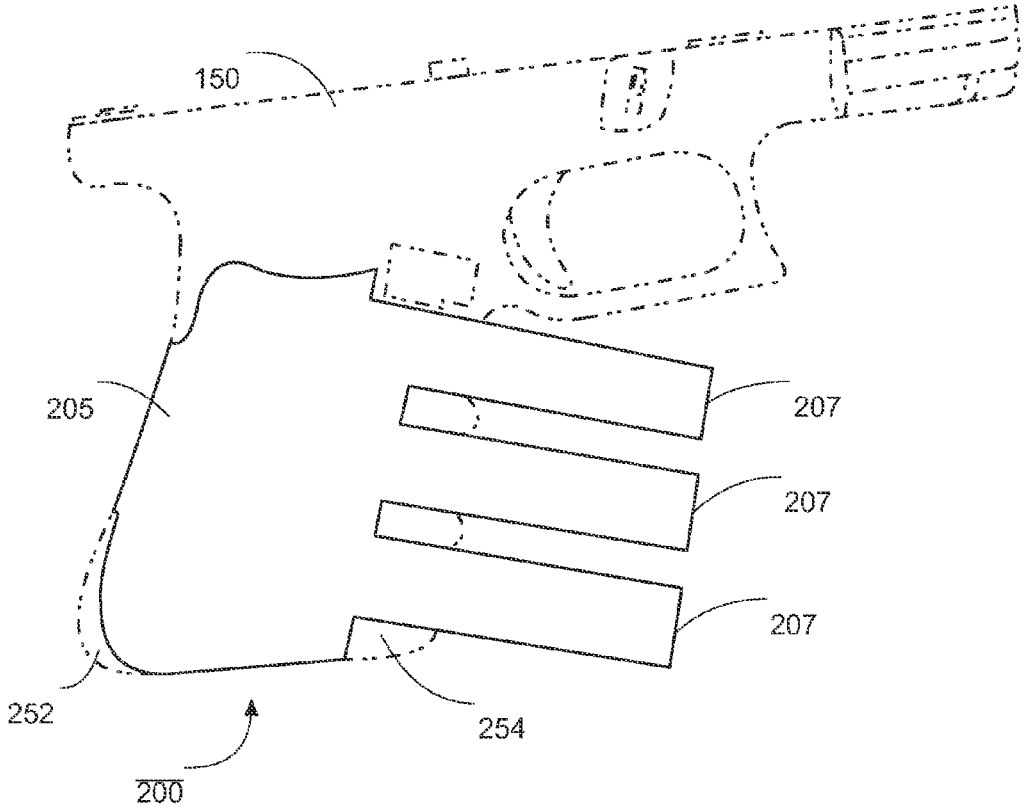
Figure 5:
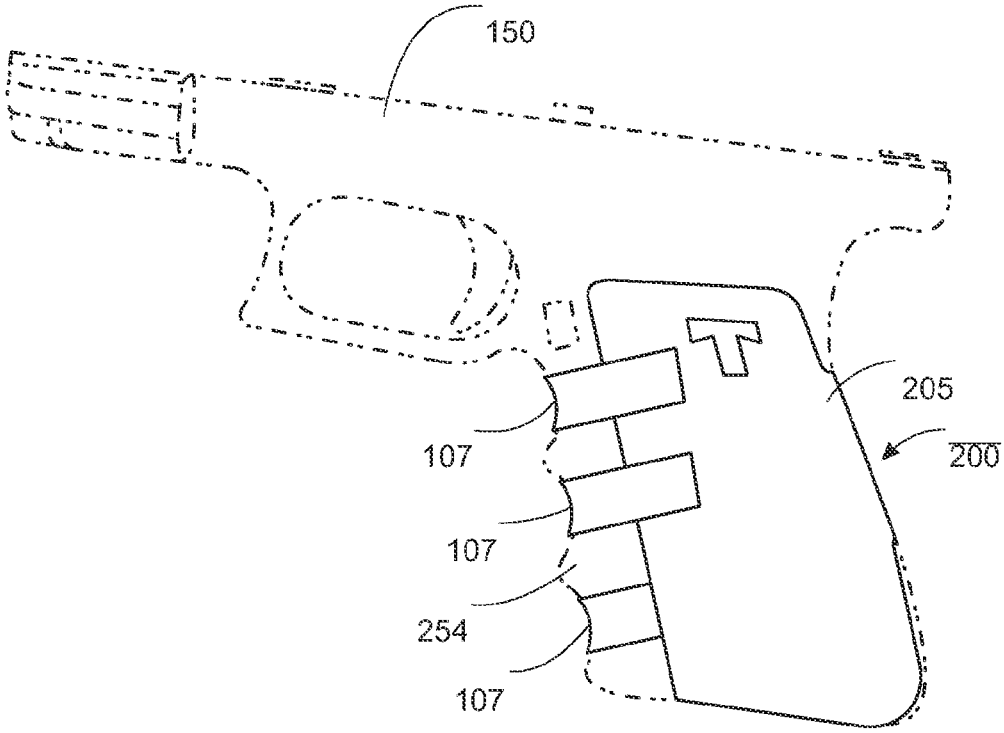

FIGS. 3 to 5 show the wraparound gun grip 200 being applied to a gun 150. As mentioned, the wraparound gun grip 200 is formed to fit specific gun models. In this case, a full size GLOCK handgun 150 is shown fitted with the wraparound gun grip 200.

Before application of the wraparound gun grip 200, it will be necessary to field strip the gun 150 for safety. This involves removing the slide and barrel of the gun 150, making it completely inoperable. After these precautions are taken, the outer surface of the grip of the gun 150 should be thoroughly cleaned, preferably, with isopropyl (rubbing) alcohol.

Once completely dry, the user should apply the wraparound gun grip's left side 201 to a corresponding side of the factory pistol grip 254, as shown. Care should be taken to align the bottom of the wraparound gun grip's left side 201 with the bottom of the corresponding side of the factory pistol grip 254 (as shown in FIG. 2). Next, the wraparound gun grip's center portion 203 should be applied to the corresponding center side of the factory pistol grip 254. Care should be taken to make sure that the center portion 203 is properly centered. After this is done, the wraparound gun grip's right side 205 can be applied to the corresponding side of the factory pistol grip 254 (as shown in FIG. 3). The finger strips 207 are then applied to the corresponding finger grips of the factory pistol grip 254 (as shown in FIG. 4). Excess portions of the finger strips 207 can be removed by cutting with a scissors, or, alternatively, the finger strips 207 can be "tucked into" the wraparound gun grip's left side 201. Finally, the wraparound gun grip 200 will, preferably, be heated with a hair dryer and pressed firmly into place several times. This will mold the wraparound gun grip 200 to the factory pistol grip 254. FIG. 5 shows the wraparound gun grip fully applied on the gun 150.

Figure 6:
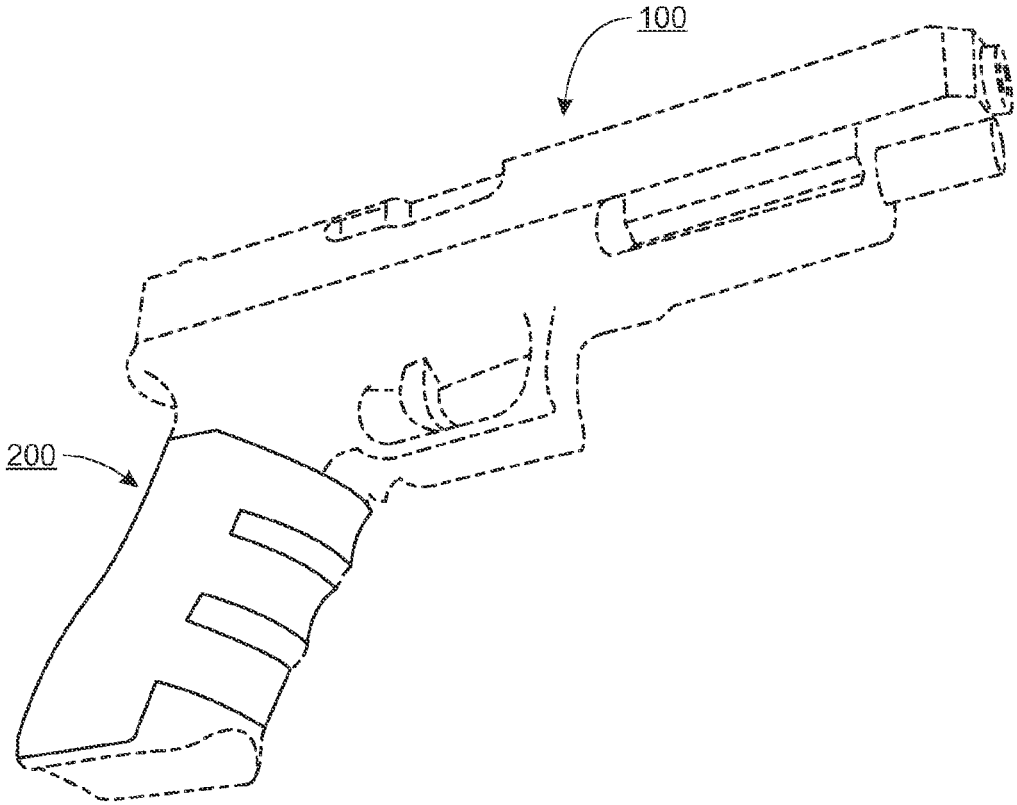
FIG. 6 shows the wraparound gun grip fully installed on the gun.
Figure 7:
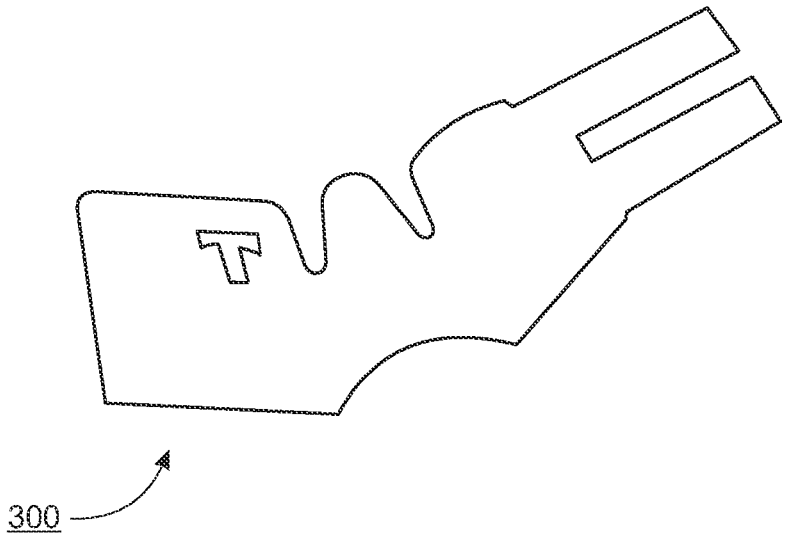
FIG. 7 shows an example of a wraparound gun grip for use on a subcompact gun.
Figure 8:
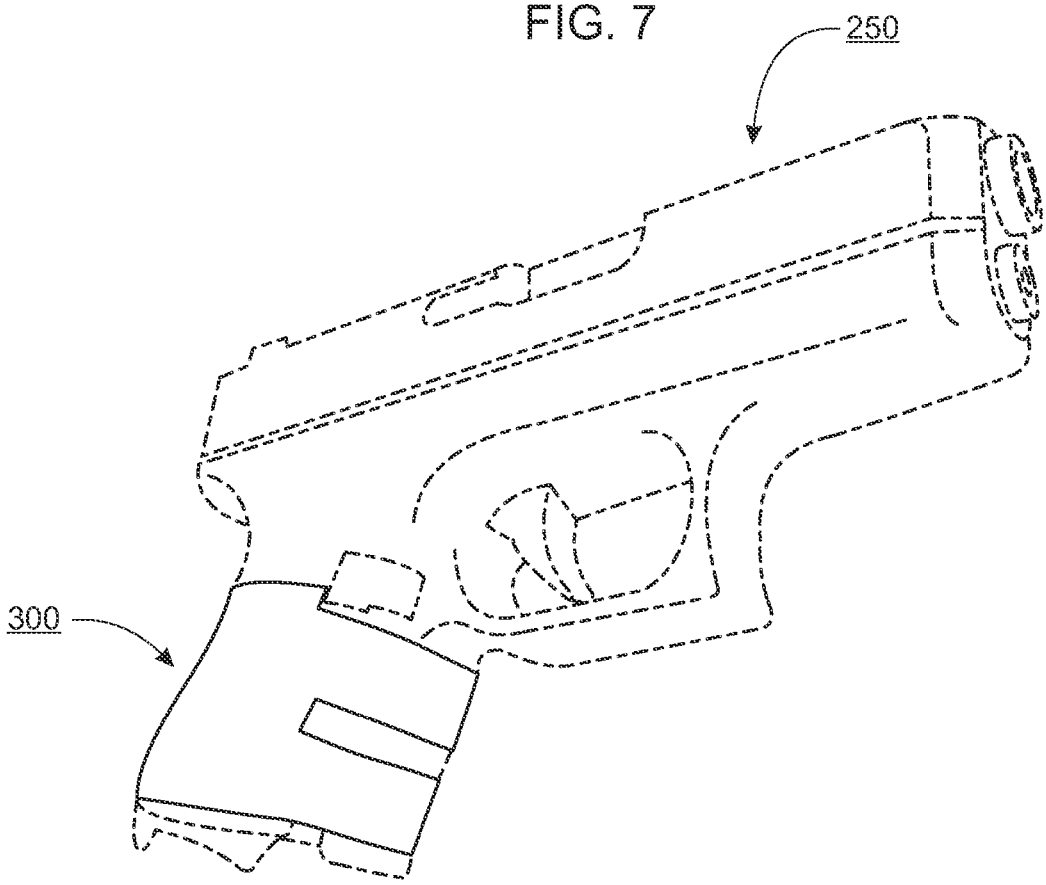
FIG. 8 shows the wraparound gun grip fully installed on the subcompact gun.

FIG. 6 shows an example of a wraparound gun grip 300 for use on a sub-compact gun 250. In this example, the wraparound gun grip 300 fits a subcompact GLOCK handgun (Models G29 and G30). FIG. 7 illustrates this wraparound gun grip 300 installed on the subcompact gun 250. It is to be noted that the wraparound gun grip 300 is smaller than the other example and includes only two finger strips so as to fit the gun 250 properly. In all other respects, the wraparound gun grip 300 is the same as above described for the full size gun 150. It is to be appreciated that in some cases (e.g., a wraparound gun grip for the Springfield XD subcompact), the present invention will include only one finger strip.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A wraparound gun grip, comprising:

a substantially flat continuous flexible sheet, the substantially flat continuous flexible sheet having a first side and a second side, the first side for adhering to a grip of a gun and the second side for providing improved gripping to a user of the gun, the substantially flat continuous flexible sheet cut to fit the gun's model;

wherein the substantially flat continuous flexible sheet is cut from a larger piece of material so as to include, after being cut:

a left side, the left side for fitting a first portion of the grip of the gun;

a right side, the right side for fitting a third portion of the grip of the gun, the third portion opposite the first portion of the gun grip when the wraparound gun grip is attached to the gun;

a center portion, the center portion for fitting a center portion of the grip of the gun, situated between the left side and the right side and being substantially smaller than both the left side and the right side; and a plurality of finger strips for fitting corresponding finger portions of the grip of the gun, each of the plurality of finger strips being a strip of material outwardly projecting from and attached to the right side only on one side and having an unbounded opposing side.

2. The wraparound gun grip of claim 1, wherein the wraparound gun grip is capable of being placed onto the gun by wrapping the wraparound gun grip around the grip of the gun.

3. The wraparound gun grip of claim 1, wherein the finger strips are tucked into another portion of the wraparound gun grip by a user to fit the gun model.

4. The wraparound gun grip of claim 1, wherein the second side achieves abrasion by including particles of silicon carbide thereon.

5. The wraparound gun grip of claim 1, wherein the wraparound gun grip is a substantially flat continuous flexible sheet cut from grip tape.

6. The wraparound gun grip of claim 1, wherein the wraparound gun grip is a substantially flat continuous flexible sheet cut from sandpaper.

7. The wraparound gun grip of claim 1, wherein the wraparound gun grip is a substantially flat continuous flexible sheet cut from a viscoelastic material.

8. The wraparound gun grip of claim 7, wherein the viscoelastic material is rubber.

9. The wraparound gun grip of claim 8, wherein the rubber is a synthetic rubber.

10. The wraparound gun grip of claim 1, wherein the gun is a handgun.

11. The wraparound gun grip of claim 1, wherein the handgun is one of a full-size handgun, a compact handgun, and a subcompact handgun.

12. A wraparound gun grip, comprising:

a first portion, the first portion structured and arranged to fit a first side of a gun grip;

a second portion, the second portion structured and arranged to fit a second side of the gun grip;

a third portion, the third portion structured and arranged to fit a third side of the gun grip, the third side opposite the first side; and a plurality of finger strips structured and arranged to fit corresponding finger portions of the gun grip, each of the plurality of finger strips being a strip of material outwardly projecting from and attached to the third portion only on one side and having an unbounded opposing side;

wherein the wraparound gun grip is cut from a substantially flat continuous flexible sheet that includes a first side and a second side, the first side for adhering to a grip of a gun and the second side including abrading particles for providing improved gripping.

13. The wraparound gun grip of claim 12, wherein the abrading particles include one or more of silicon carbide, aluminum oxide, garnet, and emery.

* * * * *